United States Patent [19]

Dambach et al.

[11] Patent Number: 4,623,211

[45] Date of Patent: Nov. 18, 1986

[54] SHIELDED CONNECTOR ASSEMBLY

[75] Inventors: Philip J. Dambach, Naperville; Jerry D. Kachlic, Lisle, both of Ill.

[73] Assignee: Molex Incorporated, Lisle, Ill.

[21] Appl. No.: 748,100

[22] Filed: Jun. 24, 1985

[51] Int. Cl.[4] ..... H01R 9/09; H01R 13/648

[52] U.S. Cl. ..... 339/143 R

[58] Field of Search ..... 339/14 R, 17 LC, 143 R; 174/35 C

[56] References Cited

U.S. PATENT DOCUMENTS

| | | | |
|---|---|---|---|
| 2,055,329 | 9/1936 | Benander | 339/221 R |
| 4,337,989 | 6/1982 | Asick et al. | 174/35 C |
| 4,389,080 | 6/1983 | Clark et al. | 339/14 R |
| 4,457,575 | 7/1984 | Davis et al. | 339/143 R |

*Primary Examiner*—Neil Abrams

*Attorney, Agent, or Firm*—Louis A. Hecht

[57] ABSTRACT

Disclosed is a shielded receptacle assembly mateable with a plug connector having an external metallic shield. The connector assembly includes an insulating receptacle housing having a mating edge with a plug-receiving cavity extending into the housing from the mating edge. An end wall opposes the mating edge and a plurality of sidewalls are joined with the end wall to define plug receiving cavity. Housing terminals are mounted in the receptacle housing for mating with corresponding plug terminals.

An integral stamped metallic conductive shield is mounted on the outside of the receptacle housing, and includes reversely bent shield engaging cantilever fingers for mating with the external plug shield. The housing includes outwardly projecting shield mounting studs electrically formed on two opposing sidewalls. Slots formed in corresponding shield sidewalls slidingly receive and engage the studs during assembly of the shield and housing members. Accurate alignment between the shield and housing is provided, while preventing outward bowing of the shield away from the housing sidewalls both before and after mating with a plug assembly.

7 Claims, 7 Drawing Figures

SHIELDED CONNECTOR ASSEMBLY

BACKGROUND OF THE INVENTION

1. Field of the Invention

The present invention pertains to shielded connector assemblies which are mateable with a shielded plug connector. More particularly, the present invention pertains to shielded receptacle assemblies mountable on a printed circuit board or the like, having an overlying metallic shield with one or more reversely bent fingers for engaging the plug shield as the plug and receptacle are mated.

2. Background of the Invention

Shielded electrical connector systems are enjoying popularity today, due in part to the recent limitations placed on radio frequency emmissions generated by electronic equipment, such as computers and other digital information systems.

One type of shielded connector system is shown in U.S. Pat. No. 4,337,989 which provides a shielding kit for use with a conventional plug and receptacle connector assembly, such as that used as an input/output (I/O) interface for electronic communications equipment. The receptacle, which is mounted on a printed circuit board, includes a dielectric housing having a mating edge and a plug-receiving cavity extending into the housing from the mating edge, an end wall opposite the mating edge, and a plurality of sidewalls joining the end wall to define the plug receiving cavity. Terminals, typically extending from the end wall, are mounted in the receptacle housing for mating contact with corresponding plug terminals. The kit includes a metallic shroud, generally U-shaped in cross-section, which fits over the dielectric receptacle, having board engaging ears for mounting to the same printed circuit board as the receptacle connector. The metallic shroud includes a number of reversely bent cantilever spring fingers located near the top housing wall, and extending into the plug receiving cavity from the mating edge. The cantilever spring fingers mate with the outer metallic shell surrounding the plug member, as the plug is inserted in the receptacle housing. The cantilever spring fingers formed as part of the metallic shroud are typically provided in groups of three or more to engage the mating plug shield at a plurality of contact points. The plurality of spring fingers offers advantages over a single contact finger design in that any warpage or other malformation of the plug shield can be accommodated more readily by a plurality of independently operating spring finger members. Such members are deflected so as to close the reverse bend during mating of the plug and receptacle assemblies.

While the conventional receptacle shown in U.S. Pat. No. 4,337,989 includes a top wall extending to the mating edge, a popular design in use today has omitted the upper housing wall portion to allow freedom of movement of the resilient spring fingers. The upper metallic shroud wall from which the fingers extend is thereby made subject to outward bowing or deflection during mating with a plug connector. In order to overcome outward bowing, and to provide the resilient forces required for proper electrical mating with the plug shield, the metallic shroud is typically formed of metal stock somewhat thicker than would otherwise be required. For example, the metallic shield in widespread use today is formed of a phospor-bronze composition, in thicknesses of approximately 0.020 inches. A thinner shield material would offer cost saving advantages, and would afford greater compliance in conforming to a mating plug configuration, but, as explained above, the shield would be subjected to outward bowing, with an attendant reduction in the contact pressure of the centrally located spring fingers.

The kit referred to above, and particularly the receptacle shield portion thereof, is intended for manual installation by an operator who is otherwise required to provide other assembly operations in the appliance manufacture. However, certain electronic appliances are being produced by automated assembly techniques, and the manufacturers of this equipment realize a cost savings if the connector components provided them can be installed automatically, as by a robotic insertion head, or the like.

SUMMARY OF THE INVENTION

It is, therefore, a principle object of the present invention to provide an improved low cost shielded receptacle assembly of the type described above which can be provided by the connector manufacturer, for simple one-step mounting by an appliance manufacturer. The improvement in the connector assembly resides in the receptacle housing further including at least three side walls, with outwardly projecting shield mounting stud means integrally formed on at least two of the side walls, and with an intermediate third sidewall overlying the spring finger members, extending to the mating edge. The shield has at least three corresponding side walls of complementary shape, and and is adapted for slideable mounting about the receptacle housing so as to enclose the three housing sidewalls.

Slots are formed in two opposing shield sidewalls for slideably receiving and engaging the studs therein. The shield is thereby securely held onto the housing so as to maintain the finger members in a fixed relationship to the mating edge of the receptacle housing. In this fixed relationship, the shield finger members engage the top housing wall in a predetermined manner to prevent outward bowing of the shield, as well as unintended wedging of the housing top wall in the reverse bend (between the shielding top wall and the spring fingers) which would cause an outward deflection of the spring fingers toward terminals mounted in the receptacle housing for mating contact with corresponding plug terminals. The terminals include board engaging portions extending in a predetermined direction to engage mounting apertures of a printed circuit board. Board engaging portions depend from the opposing shield sidewalls in the predetermined direction to engage other mounting apertures in the printed circuit board.

Another object of the present invention is to provide a shielded receptacle connector assembly which is fabricated by the connector manufacturer to produce a one-piece shielded connector assembly that can be inserted in a printed circuit board by a robot insertion head or the like automatic apparatus. In accordance with the present invention, the shield of the above described connector assembly has stud receiving slots formed in its side wall. The slots include stud engaging stop surfaces defining the above-described predetermined spaced relation between the reversely bent spring fingers and the mating edge of the housing top wall. A strap which straddles the slots, is formed in the shield sidewalls to ensure alignment of solder tails formed on the shield, with solder tails formed on the receptacle terminals. With the present invention, the close tolerance of the solder tail members, needed for reliable automated insertion in a predetermined array of printed circuit board mounting holes, is maintained in a simple, reliable cost-effective single step assembly, wherein the shield is slidingly mounted onto the receptacle housing.

The shield is held captive on the housing in the aforementioned predetermined close tolerance arrangement, without requiring plastic forming of the receptacle housing. Rather, the slot means formed in the shield sidewall include stud engaging barbs which bite into the housing studs as the shield is slid onto the housing.

BRIEF DESCRIPTION OF THE DRAWINGS

In the drawings, wherein like elements are referenced alike.

DETAILED DESCRIPTION OF THE PREFERRED EMBODIMENT

Figure 1:
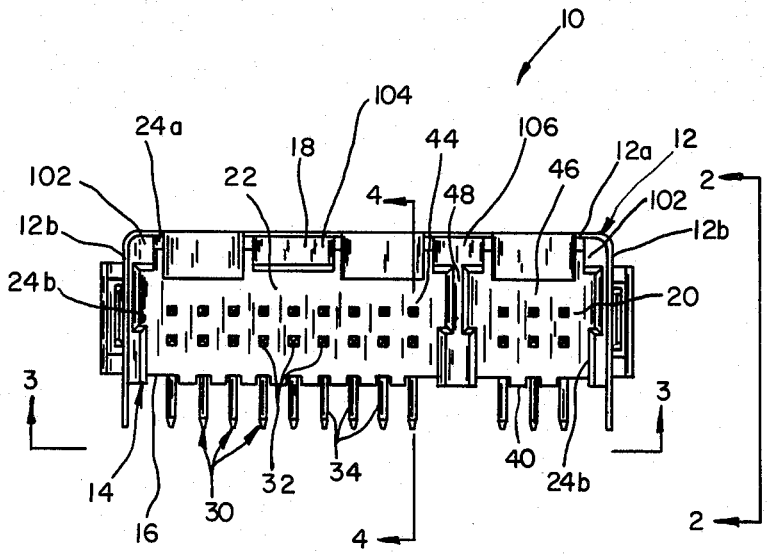
FIG. 1 is an elevation view of the shielded receptacle assembly of the present invention.

Referring now to the drawings, and in particular to FIGS. 1–5, a shielded connector assembly shown generally by 10, includes a shield 12 disposed about a header-type receptacle connector 14. Connector 14 includes an insulating receptacle housing 16 having a mating edge 18 with a plug-receiving cavity 20 extending into the housing from the mating edge. Also included is an endwall 22 opposite mating edge 18, and a plurality of sidewalls 24 joining endwall 22 to define the plug receiving cavity 20. Sidewalls 24 include a top sidewall 24*a* joined between lateral sidewalls 24*b*.

Terminals 30 are mounted in housing 16 for mating contact with corresponding plug terminals of a mating plug connector. Terminals 30 have a right angle configuration, with contact engaging portions 32 extending generally parallel to the top housing sidewall 24*a*, and solder tails or printed circuit board engaging portions 34 extending generally parallel to the rear endwall 22. Connector 14 is of a typical header connector construction wherein terminals 30 are staked in mounting apertures 36 formed in endwall 22, and are bent over mandrel-like portions 38 of endwall 22 to form the right angle bends. Connector 14 is intended for installation on a printed circuit board, with a lower board engaging surface 40 comprising the lower edge of endwall 22 and sidewalls 24*b*. Surface 40 engages an upper printed circuit board surface, while soldertail portions 34 are received in mounting apertures formed in the circuit board.

Connector 14 forms a receptacle which receives the forward end of a mating plug portion, inserted along the axis of circuit engaging terminal portions 32. The connector assembly of FIG. 1 comprises a segmented header having first and second plug receiving portions 44,46 arranged in lateral side-by-side relationship, separated by an interior wall member 48. In the particular embodiment of FIG. 1, the left hand plug receiving portion 44 receives an 18 circuit plug connector, while the right plug receiving portion 46 receives a six circuit plug connector, an arrangement typical of many input-/output communication ports found in electronic appliances today. If desired, interior wall 48 could be removed, and a 24 circuit plug connector could be mated and unmated with all of the housing terminals 30.

In order to reduce radio frequency emissions of signals carried by terminals 30, connector assembly 10 is provided with an integral stamped metallic shield 12 which is disposed about the sidewalls 24 of housing 16. In particular, shield 12 covers the housing top wall 24*a*, which is positioned between lateral sidewalls 24*b*. Each housing sidewall 24*b* has integrally formed, outwardly projecting shield mounting studs 50 with enlarged ear portions 52 at their free end. Shield member 12 has corresponding sidewalls, a top sidwall 12*a* and lateral sidewalls 12*b*. A leading edge 54 of shield 12 engages housing 16 during assembly of two components. An opposing mating edge 56 is positioned adjacent mating edge 18 of housing 16.

Figure 2A:
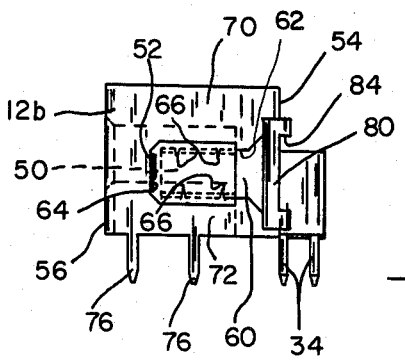
FIG. 2*a* is an end elevation view of the assembly of FIG. 1.

Slots 60 are formed in each shield sidewall 12*b* for slideably receiving and engaging the housing stud 50 therein. Each slot 60 has opposed stud engaging edges 62 and a stop edge 64 which engages a vertical edge of stud 50 to position shield 12 about housing 16 during assembly. Each stud engaging edge 62 has outwardly extending barbs 66 which bite into stud 50 during insertion, to provide a fixed positioning of shield 12 about housing 16. As can be seen in FIG. 2*a*, studs 50 and slots 60 are elongated in the direction of plug insertion, the direction parallel to the terminal circuit engaging portions 32. Continuous contact between stud engaging edges 62 and stud 50 over this elongation precludes rocking of shield 12, particularly the mating edge 56 thereof, with respect to housing 16.

Figure 2B:
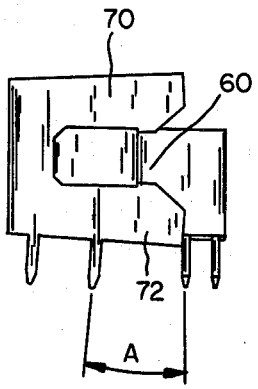
FIG. 2*b* is an end elevation view of an assembly similar to that of FIG. 2*a*, but showing a misalignment of the shield and housing terminal soldertails that is eliminated by the present invention.
Figure 3:
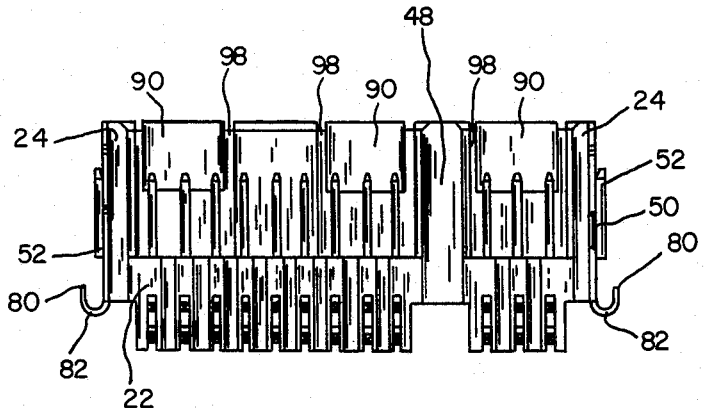
FIG. 3 is a bottom view of the assembly of FIGS. 1 and 2.

Referring now to FIGS. 2*a* and 2*b*, shield 12 is electrically connected to printed circuit board traces with depending solder tails 76 which extend in the direction of housing terminal board engaging portions 34. Slots 60 extend from the leading shield edge 54, creating an upper portion 70 and a lower portion 72 elongated in the direction of plug insertion. As indicated in diagrammatic form in FIG. 2*b*, stresses generated in the tightly fitting shield, when mounted on housing 16, cause an outward bowing of the two leg-like portion 72. A resulting misalignment, denoted by the letter "A" would prevent proper insertion of the shield solder tail portions 76 in the printed circuit board, during mounting of assembly 10. To prevent this misalignment, strap means 80, (see FIG. 2*a*) are integrally formed with shield 12, so as to straddle slot 60 adjacent the mating open and 54 of shield 12. Strap means 80 conveniently includes a reverse bend 82 formed adjacent the mating open end 54 of shield 12 (see FIG. 3). A central slot-like aperture 84 formed in reverse bend 82 allows reception of the enlarged housing ear portion 52 during assembly of shield 12 and connector 14. The misalignment shown in FIG. 2*b* is prevented by straps 80, thereby ensuring the parallel alignment of the shield and housing terminal solder tail portions 76,34 respectively. Thus, with the parallel predetermined spacing already provided by the connector manufacturer, the appliance manufacturer need only unpackage the connector assemblies 10, presenting them for automated insertion in a printed circuit board.

Connector assembly 10 is intended for mating with a shielded plug connector of the type having an external metallic shield disposed about its mating end. An example of this type of plug connector is shown in a commonly assigned U.S. Pat. No. 4,569,566, issued Feb. 11, 1986. As is shown most clearly in FIG. 4, shield 12 includes a plurality of reversely-bent cantilever spring finger members 90 integrally joined to top shield sidewall 12*a* through well defined reverse bend, or bight portions 92. Fingers 90 include camming edges 94 which make initial contact with the external plug shield, as the plug is mated with connector assembly 10. Thereafter, a substantial portion of each finger 90 is in contact with the external plug shield member.

It is important that plug shield engaging fingers 90 have the predetermined resilience or spring force needed to ensure proper electrical engagement with the plug shield, while maintaining predetermined insertion and withdrawal forces between the mating plug and receptacle assemblies. With reference to FIG. 1, the close tolerance in the spring force of the several fingers is needed despite the varying distances from the supporting shield sidewalls 12*b*. As will be readily appreciated by those skilled in the art, both before mating, and particlarly after mating, the upper shield sidewall 12*a* will tend to bow outwardly, being lifted above the upper surface of top housing sidewall 24*a*. This outward bowing is due in part to the inherent spring nature of the stamped metallic shield member, and also in response to the collapsing deflection of fingers 90 as they approach shield topwall 12*a*. Such bowing, if permitted to occur, would cause a decrease in the contact pressure of the middle finger 90.

In accordance with the present invention, spring fingers 90 are allowed a maximum range of deflection, as provided by channel-like recesses 98 formed in the top sidewalls 24*a* of housing 16. Connector assembly 10 is dimensioned for a close fit with the plug connector, with receiving cavity 20 closely conforming to the leading end of a mating plug assembly, with a minimum amount of spacing between external plug walls, and the housing sidewalls 24 defining cavity 20.

Associated with a close tolerance fit between plug and receptacle assemblies, is a further outward bowing of top housing sidewall 24*a* due an interference contact between that wall and the mating plug member. To further strengthen housing top sidewall 24*a* and to prevent its upward, or outward bowing, enlarged stiffening ribs are provided in the integral molding of housing 16. The strengthening ribs include corner ribs 102, a medial rib 104, and a strengthening rib 106 formed adjacent interior wall 48. It is comtemplated in the present invention, that the upper external plug wall would come very close to, and possibly engage, the lower surface of these strengthening ribs.

According to the present invention, the contour of bight portion 92 is well defined with respect to the edge contour of housing mating edge 18, to ensure proper deflection of finger 90, and prevents outward bowing of top shield sidewall 12*a*. As indicated in the enlarged detailed view of FIG. 5, as shield 12 is slidingly inserted over housing 16, fingers 90 engage a lower corner of housing mating edge 18. Due to the angle of finger 90, with respect to housing topwall 24*a*, the shield topwall 12*a* is drawn downwardly in close contact with housing sidewall 24*a*. This drawing down of the top shield sidewall 12*a* occurs principally in the central portions of the shield sidewall, at points remote from the strengthening effect of shield lateral sidewalls 12*b* and corrects any pre-assembly bowing in shield 12, arising from the inherent spring quality of the integral shield stamping.

During assembly of shield 12 to housing 16, slots 60 engage studs 50 to provide the required seating of top shield wall 12*a*. As can be seen with reference to FIG. 4, any over-insertion of shield 12 with respect to housing 16 would tend to wedge fingers 90 away from top shield sidewall 12*a*, making contact with the upper row of housing terminals 30. This shorted condition between terminals 30 would cause an erroneous indication during routine electrical testing of the completed circuit board assembly, a step performed by various appliance manufacturers. To prevent this wedging action, the positioning of stop edges 64 of slot 60 with respect to bight portions 92 is provided by the connector manufacturer in the close tolerance stamping operation.

Figure 5:
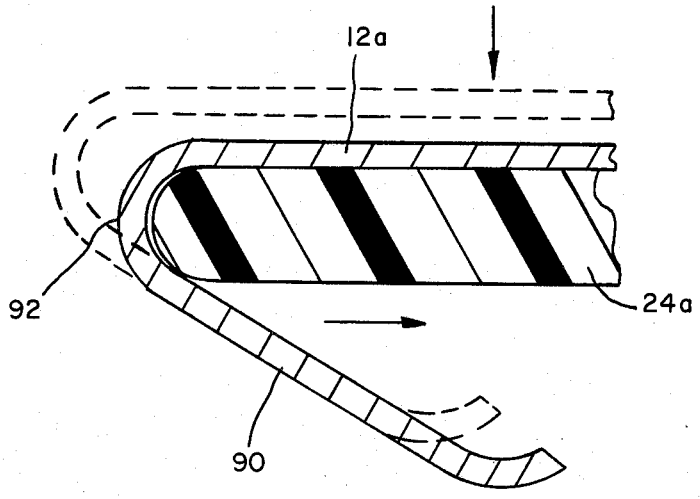
FIG. 5 is an enlarged detail view of the upper left hand portion of FIG. 4.

Stop edge 64 of slot 60 limits the insertion of shield 12 about housing 16 not only to prevent the aforementioned wedging action but also to ensure a close tolerance spaced relation between bight 92 and the mating edge 18 of housing top wall 24*a*. As indicated in FIG. 5, this spacing allows for the predetermined amount of unimpeded deflection of fingers 90 with respect to housing top wall 24*a*. As shown, the spacing takes on a crescent-shape gap appearance in cross-section, with the bottom corner of the top sidewall mating edge engaging a portion of finger 90 immediately adjacent bight 92.

Upon the full excursion of that predetermined deflection, a further porton of fingers 90 adjacent bight 92 engage the mating edge 18 and underside surface of housing top wall 24*a* to support any upward forces might be exerted to shield topwall 12*a* during plug insertion within connector assembly 10. The close tolerance stampling by the connector manufacturer, ensuring the proper relation between slot stop edge 64, and the configuration and location of bight portion 92, ensures proper shield operation during mating with a plug assembly. With the present invention, this precision metal forming is not only conveniently formed by the connector manufacturer, but is maintained during storage and subsequent delivery to a user.

This close tolerance control is especially critical in segmented headers, or in headers having a plurality spring fingers, owing to their elongated plug receiving opening. It is important that a predetermined electrical engaging force between the various fingers 90 and the external plug shields be maintained, even if those fingers are located remote from supporting shield lateral wall 12*b*.

With the present invention, shield 12 can be formed from a substantially thinner, more compliant and less costly metal blank. Typically, prior art shields comprised of a phospor-bronze composition having a typical thickness of 0.020 inches. With the present invention, the shield thickness can be cut in half, with the shield being from 0.010 inch thick stock. The thinner stock contributes to the accuracy of the precision stamping required between stop edge 64 and bight portion 92, and further prevents dislocation of bight 92 since the reverse bend is easier to form and control.

The interengagement between the shield, and the housing mating edge 18 and the studs 50 of housing 16 allow a thinner improved shield construction which maintains the cantilever spring forces constant, while preventing outwardly bowing of the shield topwall, and while maintaining alignment between the depending shield soldertails and the housing terminal soldertails, during shipment of the connector assembly 10, during installation of connector assembly 10 on a printed circuit board, and thereafter during plug insertion and electrical mating with a plug assembly. These features are provided in a single piece shield member which is installed on the receptacle housing with an inexpensive, reliable single-step sliding insertion. Further, the aforementioned advantages of reliable alignment between shield 12 and housing 16 are maintained with the biting engagement of barbs 66 and studs 50.

Figure 4:
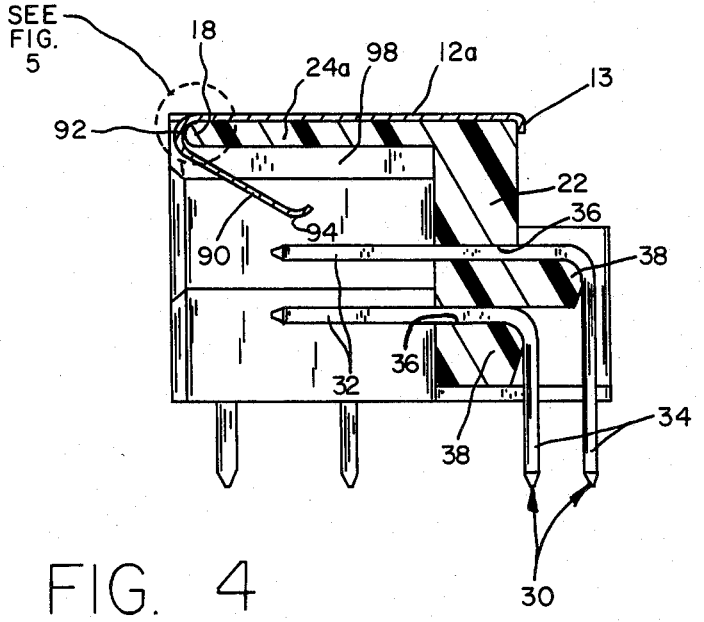
FIG. 4 is a cross-sectional elevation view taken along the lines 4—4 of FIG. 1.

If still greater control against outward bowing of shield 12 is desired, a strengthening bend or fold 13 can be made in the leading edge of top shield sidewall 12*a* (see FIG. 4). The bend is conveniently formed using the housing endwall 22 as a mandrel, after shield 12 is secured to the housing.

Figure 6:
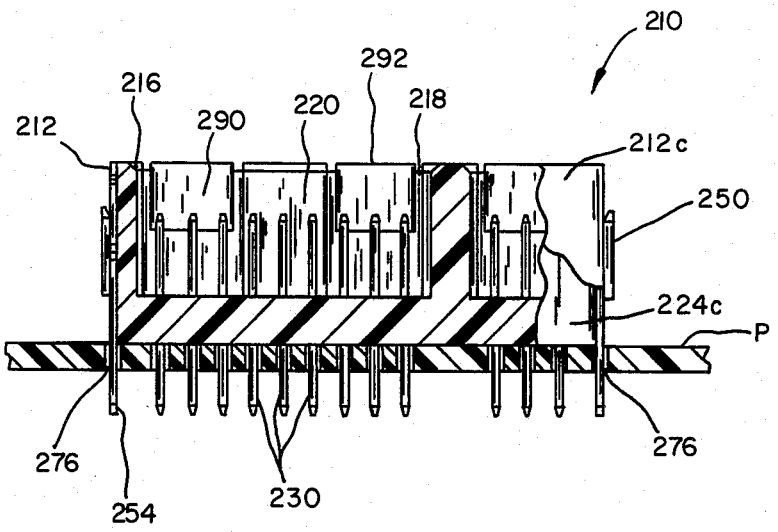
FIG. 6 is a cross-sectional elevation view of an in-line shielded receptacle assembly according to the present invention.

Referring now to FIG. 6, an alternative in-line embodiment of the present invention is shown generally at 210. The in-line connector assembly 210 is substantially identical to connector assembly 10 described above, but is designed for straight line insertion in a printed circuit board, as opposed to the right angle configuration of connector assembly 10.

Housing 216 differs from that described above having a fourth sidewall 224*c*, wherein the housing forms a totally enclosed plug receiving cavity 220. All other features of housing 216 are identical to those of housing 16 descrbied above with reference to FIGS. 1–5.

Shield 212 has a fourth wall 212*c* corresponding to housing wall 224*c* which it overlies in its fully installed condition. Thus, whereas shield 12 is generally U-shaped in cross-section, shield 212 is a fully enclosed rectangular member. As described above with respect to shield 12, shield 212 is dimensioned for a tight fit about housing 216. However, to ensure proper alignment between the bight portions 292 and the mating edge 218 of housing 216, the fourth shield sidewall 212*c*, that opposing fingers 290, has a minimum spacing with respect to its corresponding housing wall, a spacing not present in the other shield sidewalls of this embodiment, or the previous embodiment described above with reference to FIGS. 1–5.

Circuit board engaging soldertails 276 extend from the shield leading edge 254 in the same direction as housing terminal soldertail portions 234. All other features of construction installation and operation of assembly 210 are identical to those of connector assembly 10 as described above.

I claim:

1. A shielded connector assembly mateable with a plug connector having an external metallic shield, said connector assembly including:

an insulating receptacle housing having a mating edge with a plug-receiving cavity extending into the housing from the mating edge, an endwall opposite the mating edge and a plurality of sidewalls joining said endwall to define said plug receiving cavity, first terminals mounted in the receptacle housing for mating contact with corresponding plug terminals, a stamped metallic conductive shield mounted on the outside of said receptacle housing having resilient reversely-bent plug shield engaging cantilever finger members extending from said mating edge to said plug receiving cavity, the improvement wherein:

said receptacle housing further includes at least three sidewalls with projecting shield mounting stud means integrally formed on at least two of said sidewalls and with one intermediate sidewall located between said at least two sidewalls and overlying said finger members and extending to said mating edge;

said shield has at least three sidewalls adapted for slideable mounting about said receptacle housing so as to enclose at least three of said housing sidewalls;

at least two of said shield side walls including slot means for slideably receiving and engaging said stud therein;

whereby the shield is securely held onto the housing so as to maintain the finger members in a fixed relationship to said mating edge of said receptacle housing and to said first terminals, before and after plug insertion in said cavity;

wherein said first terminals include board engaging portions extending in a predetermined direction to engage mounting apertures of a printed circuit board;

said shield further includes board engaging portions depending from said sidewalls in said predetermined direction to engage other mounting apertures of said printed circuit board; and said shield further includes a substantially open end for slideably receiving said housing, said slot means extending from said open end, and said shield further including strap means straddling said slot means adjacent said open housing end to maintain a predetermined alignment between said board engaging portions of said receptacle terminal and said shield.

2. The assembly of claim 1 wherein said strap comprises a reversely bent bight portion of said sidewalls adjacent said housing receiving end.

3. The assembly of claim 2 wherein said strap bight defines a slot-like opening for receiving said stud means during securement of said shield to said housing.

4. The assembly of claim 1 wherein said stud means and said slot means are elongated in the direction of insertion of said receptacle housing within said shield, to prevent misalignment of said shield with respect to said housing in a second, normal direction.

5. The assembly of claim 1 wherein said shield further includes a strengthening rib extending along said housing receiving end of said top wall.

6. The assembly of claim 1 wherein said slot means includes barb-like housing engaging teeth formed on said shield for biting engagement with said stud means as said shield is secured to said housing.

7. The assembly of claim 1 wherein said intermediate housing sidewall includes a plurality of spaced-apart channel-like recesses extending from said mating edge, for receiving said cantilever fingers during deflection thereof in response to insertion of a plug in said cavity; and said slot means include stop surfaces for engaging said stud means to limit insertion of said housing in said shield so as to maintain a predetermined spaced relation between said cantilever fingers and said mating edge of said intermediate housing sidewall, whereby deflection of said cantilever fingers toward said first terminals during shield mounting is prevented, and outward bowing of said shield is controlled in a predetermined manner during insertion of said plug in said cavity.

* * * * *